US006788621B2

(12) United States Patent
Meylan et al.

(10) Patent No.: US 6,788,621 B2
(45) Date of Patent: Sep. 7, 2004

(54) CASE ABLE TO BE WORN ON THE WRIST BY MEANS OF WRISTBAND ASSOCIATED WITH A KEYBOARD

(75) Inventors: Frédéric Meylan, Neuchâtel (SE); Jean-Jacques Born, Morges (SE)

(73) Assignee: Asulab S.A., Marin (CH)

( * ) Notice: Subject to any disclaimer, the term of this patent is extended or adjusted under 35 U.S.C. 154(b) by 139 days.

(21) Appl. No.: 10/113,556

(22) Filed: Apr. 2, 2002

(65) Prior Publication Data

US 2002/0145946 A1 Oct. 10, 2002

(30) Foreign Application Priority Data

Apr. 6, 2001 (SE) ..... 2001/0657

(51) Int. Cl.[7] ..... G04B 47/00; G04B 37/00; A44V 5/00

(52) U.S. Cl. ..... 368/10; 368/281; 368/282

(58) Field of Search ..... 368/10, 13, 281, 368/282

(56) References Cited

U.S. PATENT DOCUMENTS 6,078,803 A * 6/2000 Fernandez Martinez .... 455/349

6,590,835 B2 * 7/2003 Farine et al. ..... 368/10

FOREIGN PATENT DOCUMENTS

| | | |
|---|---|---|
| DE | 85 10 088.9 U1 | 12/1985 |
| DE | 299 04 721 U1 | 10/1999 |
| WO | WO 00/50963 | 8/2000 |

* cited by examiner

*Primary Examiner*—Vit W. Miska
(74) *Attorney, Agent, or Firm*—Sughrue Mion, PLLC

(57) ABSTRACT

The case (2) includes means (4*a*, 4*b*; 24, 25) for attaching a wristband (3) to a wrist and means for connecting a flexible support (11) of a keyboard (13, 23) with keys (14, 15) connected inside the case (2) to a data processing unit (29) controlling a display device (16, 16*a*, 16*b*) allowing characters, supplied by the processing unit (29), to be displayed on a dial (7) of the case (2), the electric power for the electronic components of the assembly being provided by a power source (10). The case is characterized in that the flexible support (11) for the keyboard (13, 23) is connected on one side of the case (2) and its length substantially corresponds to the size of the wrist outline, and in that the wristband (3) totally covers the keyboard (13, 23) while being provided with fixed attachment means (4*b*, 24) diametrically opposite the means for connecting the keyboard (13, 23) and removable attachment means (4*a*, 25) located in proximity to said connection to the keyboard.

14 Claims, 2 Drawing Sheets

CASE ABLE TO BE WORN ON THE WRIST BY MEANS OF WRISTBAND ASSOCIATED WITH A KEYBOARD

The present invention concerns a case able to be worn on the wrist by means of a wristband or bracelet and including a keyboard supported, neither by the case, nor by the wristband but associated therewith. The keyboard includes keys allowing data to be entered into a processing unit contained in the case also including a display device for displaying the data entered or the result of a particular processing operation, and a power source for powering the electronic components. This portable case preferably takes the form of a wristwatch.

Since the wristwatch has become an almost indispensable accessory in daily life, and is thus permanently worn on the wrist, it has been sought to incorporate other functions, which have become as indispensable to the user as knowing the time, in the watch. Thus, additional operating devices have been incorporated in the wristwatch case, for example providing a calculator, compass, thermometer, biological (for example heart rate) or telephone function and many others. In certain cases, it is possible to initialise the processing unit for one of these functions by pressing on a single push-button, for example to pass from a time display mode to the heart rate display. In other cases, for example passing into calculator or telephone mode, a larger number of different pressure zones is required, i.e. a keyboard. The keys of the keyboard were first placed on rigid extensions of the wristband, and then, in order to make them more ergonomic, on the wristband strands close to the case. U.S. Pat. No. 4,255,801 discloses an electronic watch including a calculator having a wristband with links including, on one side, raised keys for the figures, and on the other side, raised keys for the calculator function. In U.S. Pat. No. 4,141,074 the same wristband strand carries all the keys of the calculator. All the keys are connected to a central processing unit located inside the case by a strip of conductive wires, passing from one link to another eventually to pass through the case. In a construction of this type, it is clear that there is a risk of the strip of conductive wires deteriorating when the wristband is twisted and especially when it is pulled when the wristband is being secured to the wrist, or conversely when it is being removed. Even though certain devices have been proposed to connect the keys easily to the processing unit, and thus to allow a worn wristband-keyboard to be replaced, this constitutes an extra cost to the user much greater than that of a simple wristband. It will also be observed that the raised keys are exposed to numerous external strains, such as friction or shocks for example when the user puts his wrist on a table. It will be noted finally that a visible keyboard reveals the complexity and thus the value of the object worn on the wrist but is of a worrying aesthetic appearance.

U.S. Pat. No. 5,020,039 discloses a flexible wristband formed of two elastomer strips sandwiching contactors whose location and functions are printed on the upper strip. Thus there are no longer hinged links, nor raised keys, which removes some of the aforementioned drawbacks. This proposed construction does not however provide a solution to the risk of breakage of the conductive wires linking the contactors, when the wristband is pulled, and the aesthetic appearance has been only slightly improved.

The object of the present invention is to overcome the drawbacks of the aforementioned prior art by providing a case able to be secured to the wrist by means of a wristband which has no keyboard, but which is also used to protect and conceal a subjacent keyboard allowing alphanumerical and/or functional data to be entered into a processing unit contained in the case.

The invention therefore concerns a portable case including means for attaching a wristband to a wrist and means for connecting a flexible support of a keyboard bearing alphanumerical characters or function signs corresponding for example to a calculator keyboard or a simplified computer keyboard. The keyboard is connected inside the case to a data processing unit controlling a display device allowing characters, supplied by the processing unit, to be displayed on a dial of the case, the electric power for the electronic components of said display device and processing unit being provided by a power source.

The case is characterised in that the flexible support for the keyboard is connected on one side of said case while its length substantially corresponds to the size of the wrist outline, and in that the wristband totally covers the keyboard while being provided with fixed locking means diametrically opposite the means for connecting the keyboard and removable locking means located in proximity to said connection.

In a preferred embodiment, the case is a watchcase also containing a movement allowing time functions to be displayed on the dial in an analogue or digital manner. When the wristwatch is worn on the wrist, the keyboard is completely concealed and protected and the wristwatch has the appearance of all wristwatches, which allows many variations from the aesthetic point of view. When one wishes to use its additional function, for example the calculator or computer function, one has simply to remove it from the wrist, place it on a flat surface and unfold the wristband on one side and the keyboard on the other.

Other features and advantages of the present invention will appear more clearly upon reading the description of embodiments of a wristwatch with a keyboard, given by way of illustrative and non-limiting examples, with reference to the annexed drawings, in which.

Figure 1:
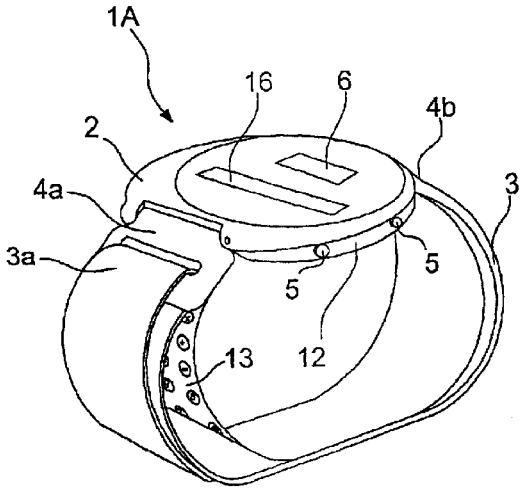
FIG. 1 shows in perspective, in the position in which it is attached to the wrist, a wristwatch with a calculator keyboard.
Figure 2:
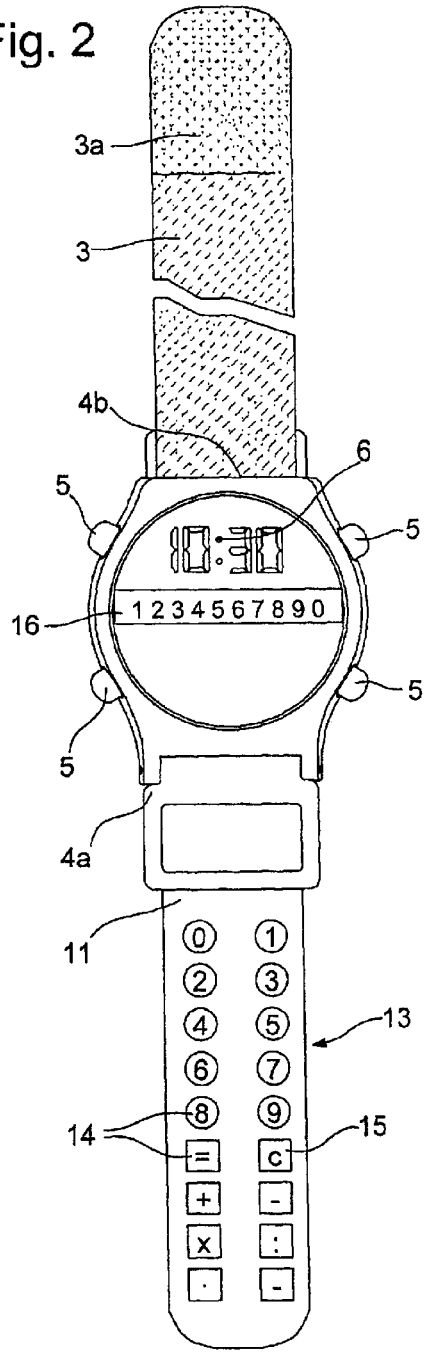
FIG. 2 shows the watch of FIG. 1, when it is unfolded on a flat surface.
Figure 3:
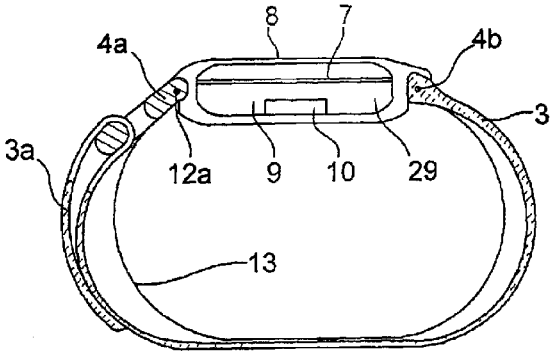
FIG. 3 shows a cross-section of the watch shown in FIG. 1, along the line 12 o'clock-6 o'clock.

With reference first of all to FIGS. 1 to 3, it can be seen that a wristwatch 1A with a digital display has been illustrated. It includes in a conventional manner a case 2 housing in particular a time-keeping circuit 9 whose constituent circuits or electronic units will not be described in detail since they are known to those skilled in the art within the horological field. Time-keeping circuit 9 controls a conventional liquid crystal time display device 6 of the matrix type, supported by a dial 7 protected by a crystal 8. For powering the electronic components of said watch 1A electrically, the case also includes a power source 10, which is for example a battery or accumulator, which can be recharged by any means known in the technical field of the invention. Middle part 12 of case 2 also includes push buttons 5 enabling the time functions of the watch and/or an additional non-time related function to be controlled, as will be explained hereinafter.

Watch 1A is secured to the wrist by means of a wristband 3 which includes on one side of middle part 12 a fixed locking member 4*b* rotatably mounted on a bar and on the diametrically opposite side, a removable locking member 4*a* formed by a buckle rotatably mounted on middle part 12 and in which the end 3*a* of a wristband strand 3, including a Velcro® type fastening, is engaged and turned over.

As can be seen, wristband 3 is designed to wrap around the wrist and to extend from only one side of case 2, as shown in FIG. 2, when it is removed from the wrist and placed on a flat surface.

According to a principle feature of the invention, watch 1A is provided with a keyboard 13, independent of wristband 3 and secured to case 2 at a zone 12*a* of middle part 12, diametrically opposite fixed locking member 4*b* of wristband 3. Thus, when wristwatch 1A is placed on a flat surface, only a small portion of removable locking member 4*a* conceals keyboard 13. Conversely, when the watch is secured to the wrist, keyboard 13 is completely concealed and protected by wristband 3, as shown in FIGS. 1 and 3, the separation between these two elements having been greatly exaggerated for improved comprehension. In reality, when the watch is worn on the wrist, these two elements are pressed together. According to a variant, the inner surface of wristband 3 has a complementary shape to that of keyboard 13 in order to allow it, in a way, to be encased and totally concealed.

In the example shown, keyboard 13 is a calculator keyboard having keys 14 carrying figures and functions signs marked so as to be read perpendicularly to the length of keyboard 13, i.e. in the same direction as time display 6. As will be explained in more detail with reference to FIGS. 4 to 6, keyboard 13 is connected to a processing unit 29 housed in case 2 and providing a matrix type liquid crystal display 16 of the data entered via keyboard 13 and of the result of the operation effected.

Passage into calculator mode may be effected in a very common manner by pressing for a determined duration, for example more than 2 seconds, a key 15 bearing the sign C. Although keyboard 13 is protected by wristband 3 when the watch is worn on the wrist, this deferred function start prevents an undesired passage into calculator mode if a shock or short application of pressure is exerted fortuitously on key 15 via wristband 3, for example if the latter is made of a flexible material. It is also possible to provide passage into calculator mode by means of pressure exerted on one of push buttons 5.

In the preceding description, the two time 6 and calculating 10 displays are separated. According to a variant, it is possible to have only one matrix type liquid crystal display by providing means in processing unit 29 for switching between the time mode and calculator mode or conversely when pressure is exerted on key 15 or on a push-button 5 as indicated previously.

Figure 4:
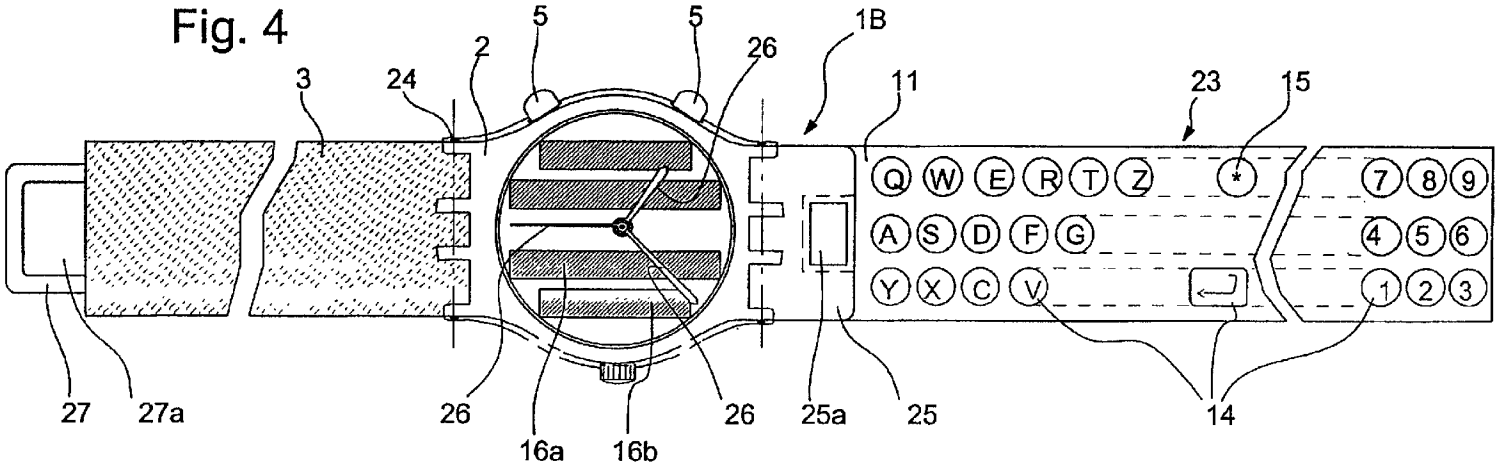
FIG. 4 shows, in an unfolded position, a second embodiment of a wristwatch with a simplified computer keyboard.

With reference now to FIG. 4, a wristwatch 1B is shown with analogue time display by means of hands 26, including a keyboard 23, which, as previously, is connected to case 2 opposite fixed locking member 4*b* of wristband 3. Keyboard 23 includes keys 14 identified by alphanumerical and functional markings corresponding to those of a simplified computer keyboard. As can be seen, unlike the first embodiment, these markings are legible parallel to the length of keyboard 23 and can be arranged in three rows and covered by wristband 3 without adversely affecting the aesthetic appearance when the watch is worn on the wrist. Keyboard 23, as previously, is connected inside case 2 to a processing unit 29 controlling a matrix type liquid crystal display able to include several lines 16*a*, 16*b*, . . . on the watch dial, these lines being able to be read in the same direction as the markings borne by keys 14 of keyboard 23. In the example described of an analogue time display, the passage of hands 26 above digital display zones 16*a*, 16*b*, . . . constitutes an acceptable inconvenience. According to techniques known in the horological field, it is also possible to superpose all of hands 16 temporarily on the 12 o'clock or 6 o'clock time position when one passes into "computer" mode by pressing a push-button 5 or a determined key 15 on the keyboard. According to another variant, the inconvenience caused by the hands can be removed by opting for a digital time display. By making a matrix type liquid crystal display over most of the surface of dial 7 and by providing switching means in processing unit 29, it is in fact possible, for example by exerting pressure on a push-button 5 or on a determined key 15 of the keyboard, to cause the display to swing through 90° so that the time display can be read in the usual manner, perpendicular to the length of wristband 3 when the watch is worn on the wrist, and so that display lines 16*a*, 16*b*, . . . can be read parallel to the length of wristband 3 when the watch is placed on a flat surface to make use of keyboard 23.

In the embodiment shown in FIG. 4, wristband 3, as previously, is in a single piece with a fixed locking member 24 opposite keyboard 23, and a removable locking member in two parts that may be clipped together, a part 25 being rotatably mounted above one end of keyboard 23 and including a cut out portion 25*a* in which a tongue 27*a* of second part 27 engages. It is clear that those skilled in the art can adapt certain other locking systems provided with wristbands with two strands to a wristband, which includes only one, as is the case for the present invention.

Figure 5:
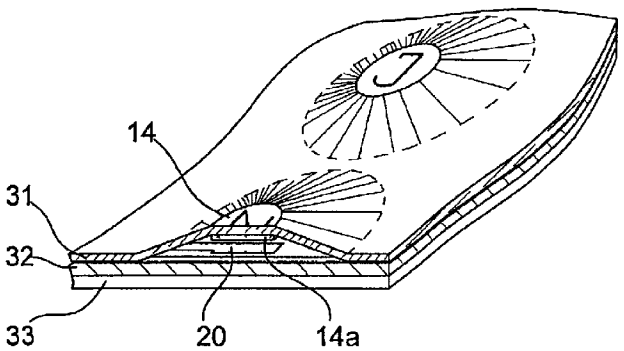
FIG. 5 shows in a partially torn away perspective view, a portion of keyboard containing two keys.

FIG. 5 shows a partially torn away perspective view of a key 14 of an alphanumerical character of keyboard 13 or 23 made mainly of a rubber-like material. A strip of flexible printed circuit 32, for example a Kapton® film, carrying metal paths 20 on at least one of its faces is sandwiched between two strips 31 and 33 made of a rubber-like material. First strip 31 is shaped to form keys 14 and second strip 33 to carry flexible printed circuit 32. Each key 14 in the shape of a truncated cone includes under its upper part a conductive disc 14*a* forming a contactor when it is pressed to short-circuit two metal paths 20. When the key is released, the resilience of the material enables disc 14*a* to return to the rest position, i.e. removed from paths 20.

In an alternative embodiment, which is not shown, alphanumerical and functional keys 14 of keyboard 13 or 23 can be capacitive or piezo-resistive keys sensitive to the approach or contact of a user's finger, these two technologies being known to those skilled in the art.

Figure 6:
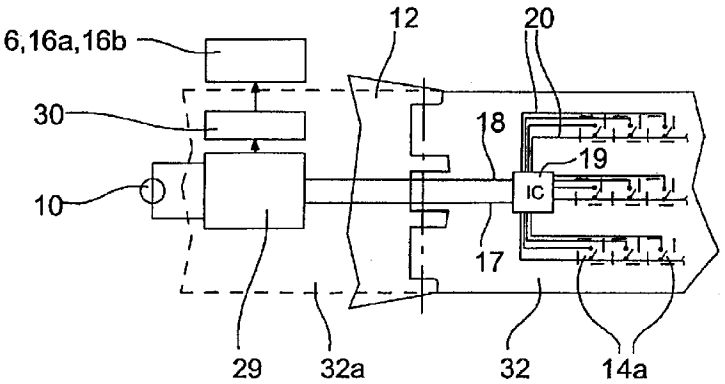
FIG. 6 shows schematically the connecting means and the elements contained inside the case.

FIG. 6 shows schematically the electronic components necessary for the transmission of electric signals between keys 14, 15 of keyboard 13 or 23 and the components integrated in case 2, the keyboard being represented solely by a portion of the flexible printed circuit 32 close to middle part 12 and by the extension 32*a* inside case 2. In the embodiment shown, flexible printed circuit 32 includes an integrated encoder circuit 19 connected on the one hand by metal paths 20 to a series of switches 14*a*, and on the other hand by two metal paths 17, 18 which extend over portion 32*a* inside the case as far as processing unit 29 powered by a power source 10 and connected to a drive circuit 30 for display devices 6 or 16*a*, 16*b*, . . . .

Integrated encoder circuit 19 receives clock signals from a generator unit and includes a microprocessor clocked by the oscillator unit or a wired logic to send, in series on line

18, the binary word corresponding to the symbol of the key pressed so that processing unit 29 processes this word. Processing unit 29 may be a microcontroller clocked at a frequency of the order of 32 KHz supplied by a quartz oscillator unit (not shown). It should be noted that the oscillator unit of integrated encoder circuit 19 and that of processing unit 29 may be the same as that of the watch's time-keeping circuit 9.

Integrated encoder circuit 19 offers the advantage of only having two metal communication paths 17, 18 between keyboard 13 or 23 and the inside of case 2 and of thus allowing mechanical reinforcement of said paths. However, since keyboard 13 or 23 is not subject to any traction stress, it is perfectly possible to omit integrated encoder circuit 19 by connecting all of paths 20 of contactors 14*a* directly to processing unit 20.

It will also be observed that upper strip 31 made of rubber-like material may be extended slightly beyond the end of middle part 12 and may form a sealing gasket there with lower strip 33.

The examples that have just been described may form the subject of numerous alternative embodiments, within the reach of those skilled in the art without departing from the scope of the present invention.

What is claimed is:

1. A portable case including means for attaching a wristband to a wrist and means for connecting a flexible support of a keyboard with keys bearing alphanumerical characters or function signs, said keyboard being connected inside the case to a data processing unit controlling a display device allowing characters, supplied by the processing unit, to be displayed on a dial of the case, the electric power for the electronic components of said display device and data processing unit being provided by a power source, wherein the flexible support for the keyboard is connected on one side of the case and its length substantially corresponds to the size of the wrist outline, and in that the wristband totally covers the keyboard while being provided with fixed locking means diametrically opposite the means for connecting the keyboard and removable locking means located in proximity to said connection to the keyboard.

2. The portable case according to claim 1, wherein it further contains a watch movement allowing time functions to be displayed on the dial in an analogue or digital manner.

3. The portable case according to claim 2, wherein the display of the time functions is of the analogue type, while being separate from the display of the characters provided by the processing unit.

4. The portable case according to claim 2, wherein the time function display is of the analogue type, while being merged with the display device for the characters provided by the processing unit, the change in display mode being obtained via pressure on a push-button of the case or on a key of the keyboard.

5. The portable case according to claim 1, wherein the characters and/or function signs borne by the keys are arranged to be read perpendicularly to the length of the keyboard.

6. The portable case according to claim 5, wherein the keys of the keyboard bear the figures and function signs of a calculator.

7. The portable case according to claim 1, wherein the characters and/or function signs borne by the keys are arranged to be read parallel to the length of the keyboard.

8. The portable case according to claim 7, wherein the keys of the keyboard are arranged in three rows and bear alphanumerical characters and function signs globally arranged like those of a simplified computer keyboard.

9. The portable case according to claim 1, wherein the display device for characters provided by the processing unit includes several lines.

10. The portable case according to claim 1, wherein the free end of the wristband is of the Velcro® type and is turned over onto a buckle forming the removable locking means for securing the wristband to the wrist.

11. The portable case according to claim 1, wherein the free end of the wristband and the removable locking means are formed by a complementary clipping device.

12. The portable case according to claim 1, wherein the support for the keyboard is formed by a first and a second layer of a rubber-like material sandwiching a flexible insulating film supporting conductive strips directly or indirectly connecting the keyboard keys to the processing unit.

13. The portable case according to claim 12, wherein the keyboard support also incorporates an integrated encoder circuit acting as a communication interface between the keys of the keyboard and the processing unit housed in the case by reducing the number of connecting wires which have to pass through the case to two.

14. The portable case according to claim 1, wherein the keyboard keys are made using capacitive zones, resistive contacts or pressure sensitive contactors.

* * * * *